US011259621B2

(12) United States Patent
Butcher

(10) Patent No.: US 11,259,621 B2
(45) Date of Patent: Mar. 1, 2022

(54) MASCARA APPLICATOR SYSTEM FOR APPLYING MASCARA WITH THE DOMINANT HAND

(71) Applicant: John Butcher, Yardley, PA (US)

(72) Inventor: John Butcher, Yardley, PA (US)

( * ) Notice: Subject to any disclaimer, the term of this patent is extended or adjusted under 35 U.S.C. 154(b) by 0 days.

(21) Appl. No.: 16/838,001

(22) Filed: Apr. 1, 2020

(65) Prior Publication Data

US 2021/0307489 A1 Oct. 7, 2021

(51) Int. Cl.

| | |
|---|---|
| ***A46B 11/00*** | (2006.01) |
| ***A45D 40/26*** | (2006.01) |
| ***A46B 5/00*** | (2006.01) |
| ***A46B 5/02*** | (2006.01) |
| ***A46B 9/02*** | (2006.01) |

(52) U.S. Cl.

CPC ..... *A45D 40/265* (2013.01); *A46B 5/0083* (2013.01); *A46B 5/02* (2013.01); *A46B 9/021* (2013.01); *A45D 2200/10* (2013.01); *A46B 2200/1053* (2013.01)

(58) Field of Classification Search

CPC ..... A45D 40/265; A46B 5/02; A46B 5/0083; A46B 9/021; A46B 2200/1053

USPC ..... 401/129

See application file for complete search history.

(56) References Cited

U.S. PATENT DOCUMENTS

| | | | | |
|---|---|---|---|---|
| 3,921,650 A | | 11/1975 | Montgomery | |
| 4,165,755 A | | 8/1979 | Cassai | |
| 4,222,677 A | | 9/1980 | Cervantes | |
| 4,428,388 A | | 1/1984 | Cassai et al. | |
| 4,600,328 A | | 7/1986 | Clements | |
| 4,717,032 A | * | 1/1988 | Wu | A45D 40/265 215/228 |
| 5,611,361 A | | 3/1997 | Leone | |
| 6,050,273 A | * | 4/2000 | Lhuisset | A45D 40/265 132/317 |
| 6,309,125 B1 | * | 10/2001 | Peters | A46B 11/0006 401/126 |
| 6,532,967 B1 | * | 3/2003 | Dumler | A46B 9/021 132/218 |
| 6,718,990 B1 | | 4/2004 | Chastain et al. | |
| 7,465,114 B2 | | 12/2008 | Kress et al. | |

(Continued)

FOREIGN PATENT DOCUMENTS

| | | |
|---|---|---|
| CN | 102176844 A | 6/2014 |
| DE | 199 00 784 | 7/2000 |

(Continued)

*Primary Examiner* — Jennifer C Chiang

(74) *Attorney, Agent, or Firm* — LaMorte & Associates P.C.

(57) ABSTRACT

A system for the application of mascara to both eyes using the dominant hand. The system has a container and an applicator. The applicator is used to transfer mascara from the container to the eyes. The applicator has a handle, a brush head and a rod. The handle progresses along an imaginary midline and supports the brush head in line with, or parallel to, the midline. The rod has at least one offset section. The rod is long enough to enable a person to position the brush head in front of the left eye from the right side of the head, or in front of the right eye from the left side of the head. The offset section of the rod prevents the applicator from blocking the vision from a near eye when applying mascara across the face to a far eye.

17 Claims, 9 Drawing Sheets

(56) References Cited

U.S. PATENT DOCUMENTS

| | | | | |
|---|---|---|---|---|
| 7,762,269 | B2 | 7/2010 | Wyatt et al. | |
| 10,492,589 | B2 * | 12/2019 | Limongi ..... | A45D 34/04 |
| 2008/0283083 | A1 | 11/2008 | Piao | |
| 2011/0030718 | A1 * | 2/2011 | Gueret ..... | A46B 9/021 132/218 |
| 2011/0174328 | A1 | 7/2011 | Cerutti et al. | |
| 2014/0109928 | A1 | 4/2014 | Simard | |
| 2017/0360179 | A1 | 12/2017 | Manici | |
| 2020/0046108 | A1 | 2/2020 | Bellah | |

FOREIGN PATENT DOCUMENTS

| | | |
|---|---|---|
| EP | 2 974 618 | 1/2016 |
| FR | 3 042 391 | 4/2017 |
| WO | WO 2014/113145 | 7/2014 |

* cited by examiner

MASCARA APPLICATOR SYSTEM FOR APPLYING MASCARA WITH THE DOMINANT HAND

BACKGROUND OF THE INVENTION

1. Field of the Invention

In general, the present invention relates to mascara systems and the structure of the applicator brushes used in mascara systems. More particularly, the present invention relates to the structure of the applicator brush and features that enable one-handed use.

2. Prior Art Description

Most people have a dominant hand. That is, most people are either left-handed or right-handed. In human biology, a person tends to use their dominant hand more often than their on-dominant hand. Furthermore, the dominant hand is typically used to perform precise movements, such as those used when writing or drawing. As a consequence, a person tends to have far better hand-eye coordination with their dominant hand than they do with their non-dominant hand.

When a person applies makeup to their own face, it often requires the use of fine motor skills. Accordingly, a person generally uses their dominant hand when applying makeup to the face. However, depending upon the makeup being applied, it is often not possible for a dominant hand to be used. Or if the dominant hand is used, the dominant hand is manipulated in an unnatural way, therein causing inferior results. For instance, mascara is a cosmetic that is typically applied to the eyelashes on the left eye and right eye. The mascara is used to darken, thicken, lengthen, and/or otherwise define the eyelashes. Typically, mascara is in liquid form, contained in a vial and is applied to the eyelashes using a small handheld brush. If a person is right-handed, they typically grasp the applicator brush with their right hand and apply the mascara to the eyelashes of the right eye. This is typically done in front of a mirror. However, if the person attempts to use their right hand to apply mascara to their left eye, then either they must reverse their grip so as to approach the left eye from the left side. This causes a person to use the brush at a compromised angle, for visibility and to access the lashes close to the bridge of the nose. This compromised angle negates the benefits of the brush design and produces inferior results, as compared to the right eye. It is also possible for the person to use their left, non-dominant hand for application to the left eye, but precision is lost and there is clean-up required as well as producing inferior results.

In the prior art, certain makeup applicators are designed to be used by the left hand or the right hand. When the applicator is changed between hands, the applicator must be inverted, or the applicator head changed. Such prior art is exemplified by U.S. Pat. No. 4,165,755 to Cassai and U.S. Pat. No. 6,718,900 to Chastain. Also, in the prior art, applicator heads have been designed that enable the applicator to be used with either the right hand or the left hand without the need for inversion. Such prior art applicators are exemplified by U.S. Pat. No. 4,165,755 to Cassai, U.S. Patent Application No. 2014/0109928 to Simard, and U.S. Patent Application No. 2011/0174328 to Cerutti. Although such prior art systems help with the ambidextrous application of makeup, they do little to enable a person to apply makeup with only the dominant hand.

A need therefore exists for an improved mascara applicator system that enables a person to apply mascara to both the left eye and the right eye using only a dominant hand and without blocking the view of a mirror. This need is met by the present invention as described and claimed below.

SUMMARY OF THE INVENTION

The present invention is a system for the application of mascara to both of a user's eyes using the dominant hand and without adversely affecting the effectiveness of the applicator. The system has a container and an applicator. The container holds a volume of mascara. The applicator is used to transfer the mascara from the container to the eyes. The applicator has a handle, a brush head and an elongated rod that connects the handle to the brush head. The handle progresses along an imaginary midline between a first end and a second end. The elongated rod extends as a cantilever from the first end of the handle. The elongated rod supports the brush head either in line with the midline of the handle or parallel to that midline. The elongated rod has at least one curved section or inclined section that is not in line with said midline. A short straight section can be provided that leads into the curved section, wherein the straight section is in line with and the midline.

The elongated rod is long enough to enable a person to position the brush head in front of the left eye from the right side of the head, or in front of the right eye from the left side of the head. The curved section or inclined section of the elongated rod prevents the applicator from blocking the vision from a near eye when applying mascara across the face to a far eye. This enables a person to effectively apply mascara to both eyes while holding the applicator in the dominant hand and without having to hold the applicator in an ineffective position. Since a person has more precise motor skills in his/her dominant hand, the mascara can be applied with more precision. Furthermore, the quality of the application will be more consistent across both eyes.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention mascara applicator system can be embodied in many ways, only a few exemplary embodiments are illustrated. The exemplary embodiments are being shown for the purposes of explanation and description. The exemplary embodiments are selected in order to set forth two of the best modes contemplated for the invention. The illustrated embodiments, however, are merely exemplary and should not be considered limitations when interpreting the scope of the appended claims.

Figure 1:
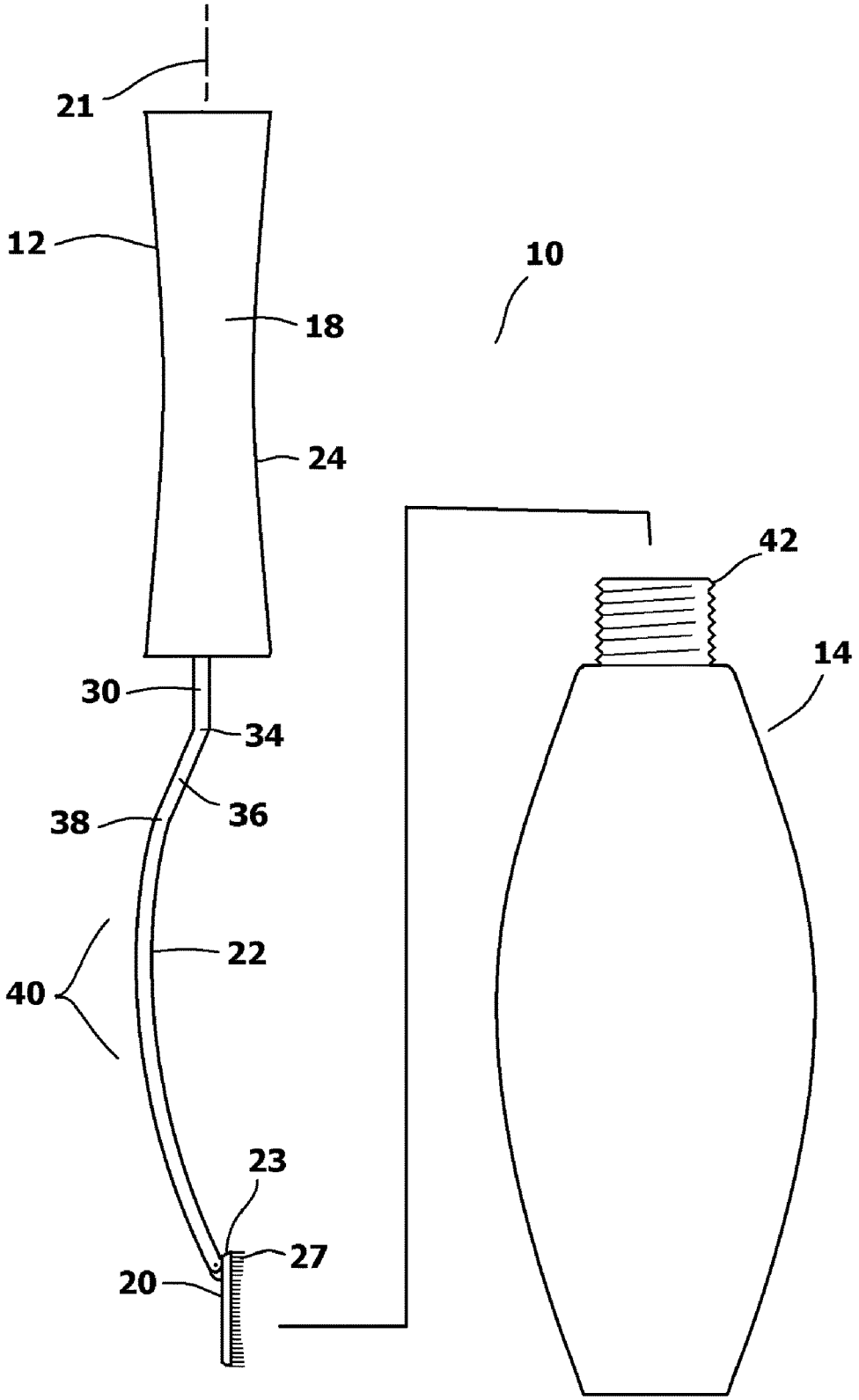
FIG. 1 is a front view of an exemplary embodiment of a mascara application system having an applicator and a container that are disconnected.
Figure 2:
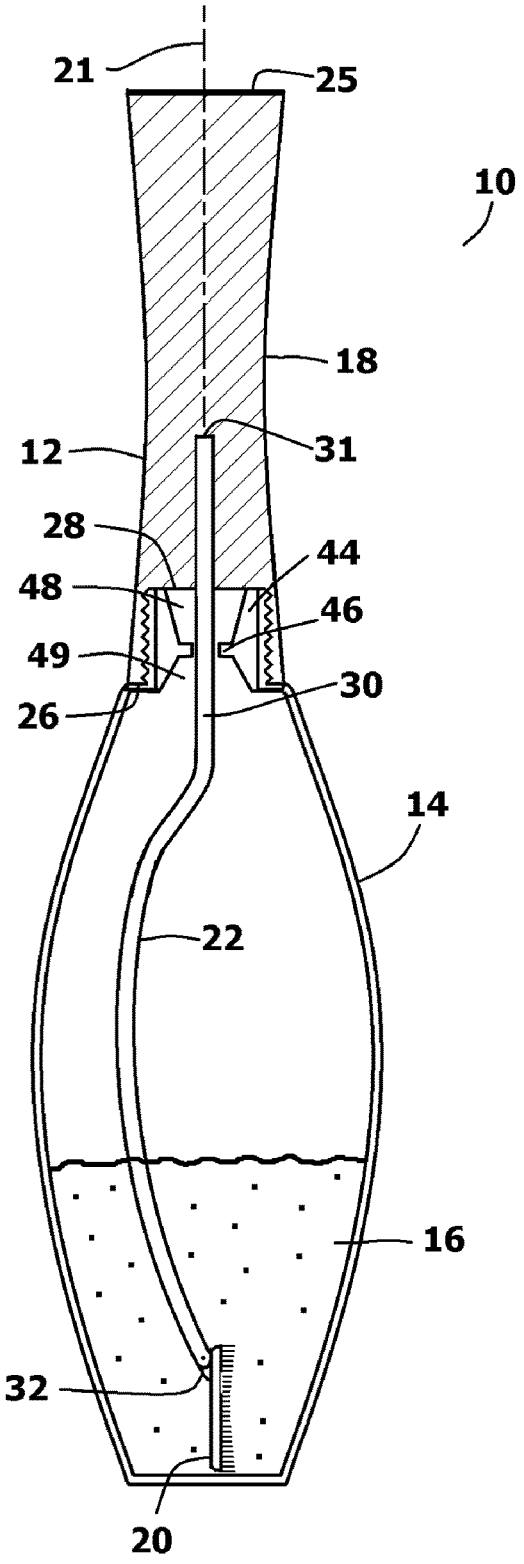
FIG. 2 is a cross-sectional view of the exemplary embodiment of FIG. 1 with the applicator and container shown connected.

Referring to FIG. 1 and FIG. 2, a mascara application system 10 is shown. The mascara application system 10 consists of an applicator 12 and a container 14. The container 14 holds a volume of mascara 16. The applicator 12 is used to remove some of the mascara 16 from the container 14 and apply the mascara 16 to the eyelashes of a person.

The applicator 12 has a handle 18, a brush head 20 and a rod 22 that connects the brush head 20 to the handle 18. The handle 18 serves two purposes. The handle 18 has a contoured exterior surface 24 that is used to comfortably grip the handle 18. The handle 18 also serves as a cap to the container 14 that holds the mascara 16. The handle 18 is symmetrically formed about a midline 21 and has a first end 25 and an opposite second end 26. A cap depression 28 is formed in the first end 25. The cap depression 28 is symmetrically formed about the midline 21 and is threaded so it can be tightened onto the container 14.

The rod 22 extends into the handle 18 through the center of the cap depression 28. The rod 22 is flexible and extends between a first end 31 and a second end 32. The first end 31 of the rod 22 is anchored within the handle 18. This causes the rod 22 to extend from the handle 18 as a cantilever. The second end 32 of the rod 22 supports the brush head 20. The rod 22 is elongated and follows a complex shape between its first end 31 and its second end 32. The preferred length of the rod 22 is between seven centimeters and thirteen centimeters. The need for this extended length is later explained. The rod 22 has a straight section 30 that extends from the first end 31 of the rod 22 to a first transition point 34. The straight section 30 extends along the midline 21. At the first transition point 34, the rod 22 inclines away from the midline 21 at an angle of between 20 degrees and 45 degrees, therein forming an inclined section 36. The inclined section 36 extends from the first transition point 34 to a second transition point 38. At the second transition point 38, the rod 22 begins to follow a curve, therein forming a curved section 40. The curved section 40 extends from the second transition point 38 to the brush head 20. The curved section 40 reaches an apex at a point generally halfway between the handle 18 and the brush head 20.

The second end 32 of the rod 22 terminates at the brush head 20. The rod 22 holds the brush head 20 in line with the midline 21 of the handle 18. The brush head 20 has a base 23 that supports a formation of brush bristles 27. The brush bristles 27 can be traditional mascara bristles that are either molded or formed from twisted plastic. The base 23 of the brush head 20 is preferably attached to the second end 32 of the rod 22 at a flexible connection 29, such as a pivot hinge or a flex wire hinge. In this manner, the brush head 20 can alter its orientation relative the rod 22. This feature helps the brush head 20 pass into, and out of, the container 14.

The container 14 has a threaded neck 42 that is sized to engage the cap depression 28 in the handle 18. Within the container 14, a wiper insert 44 is set in, or just below, the threaded neck 42. The wiper insert 44 removes excess mascara from the brush head 20 as the brush head 20 is retracted out of the container 14. The wiper insert 44 has an annular wiper 46. The annular wiper 46 is interposed between an upper guide chamber 48 and a lower guide chamber 49. Both the upper guide chamber 48 and the lower guide chamber 49 are frustrum shaped with walls that converge toward the annular wiper 46. The shapes of the guide chambers 48, 49 help to properly orient the brush head 20 as the brush head 20 is moved through the annular wiper 46.

Below the wiper insert 44, the container 14 has a bulbous shape. The curvature of the container 14 is designed to accommodate the curved shape of the rod 22 that extends from the handle 18. In this manner, when the applicator 12 is attached to the container 14 and the rod 22 and brush head 20 extend into the container 14, the rod 22 is not deformed by the shape of the container 14.

Figure 3:
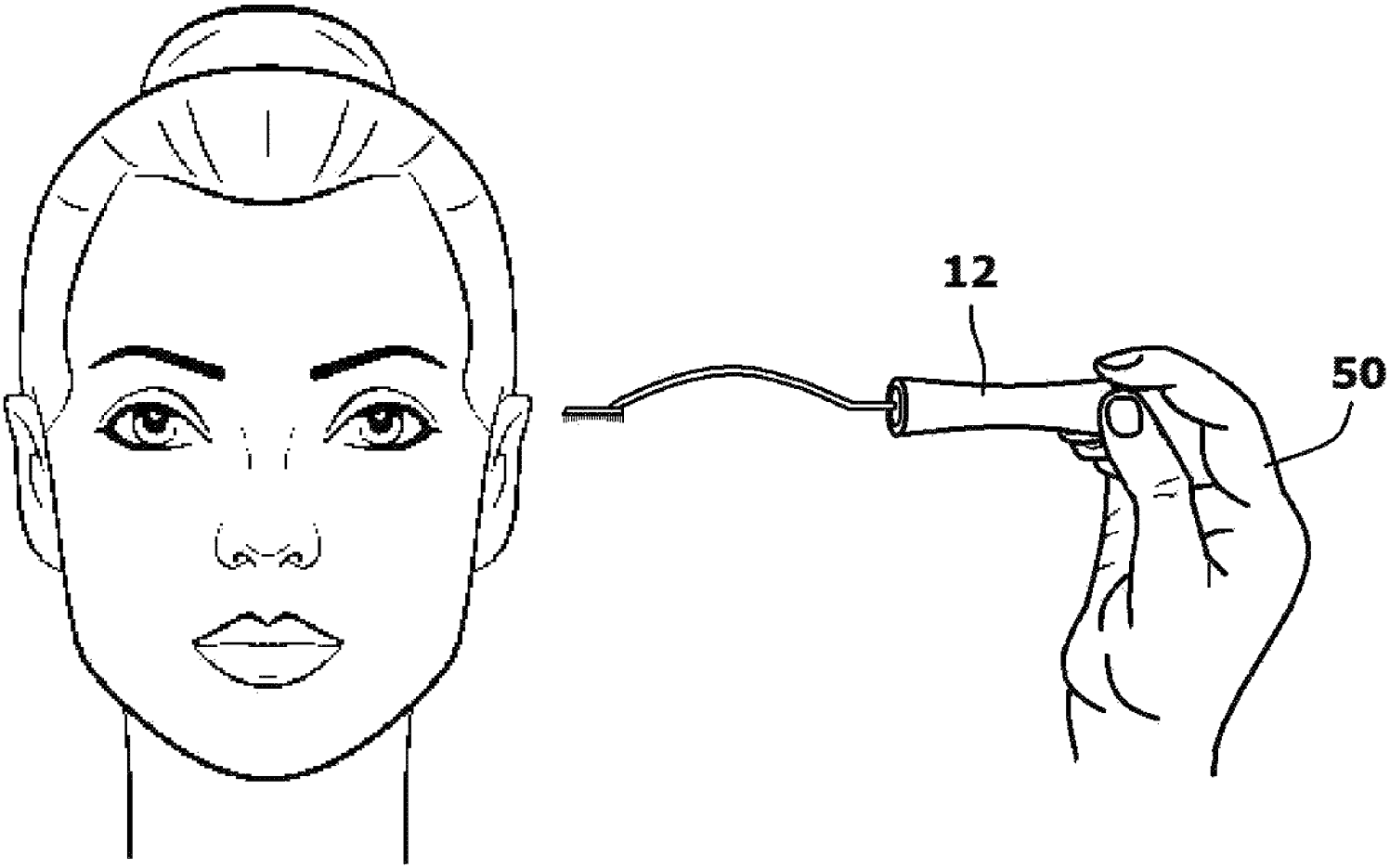
FIG. 3 shows the applicator of the exemplary embodiment in conjunction with a dominant hand and face to explain use of the invention.

Referring to FIG. 3 in conjunction with FIG. 1 and FIG. 2, it can be seen that the applicator 12 is drawn from the container 14 and is held in a user's dominant hand 50.

Figure 4:
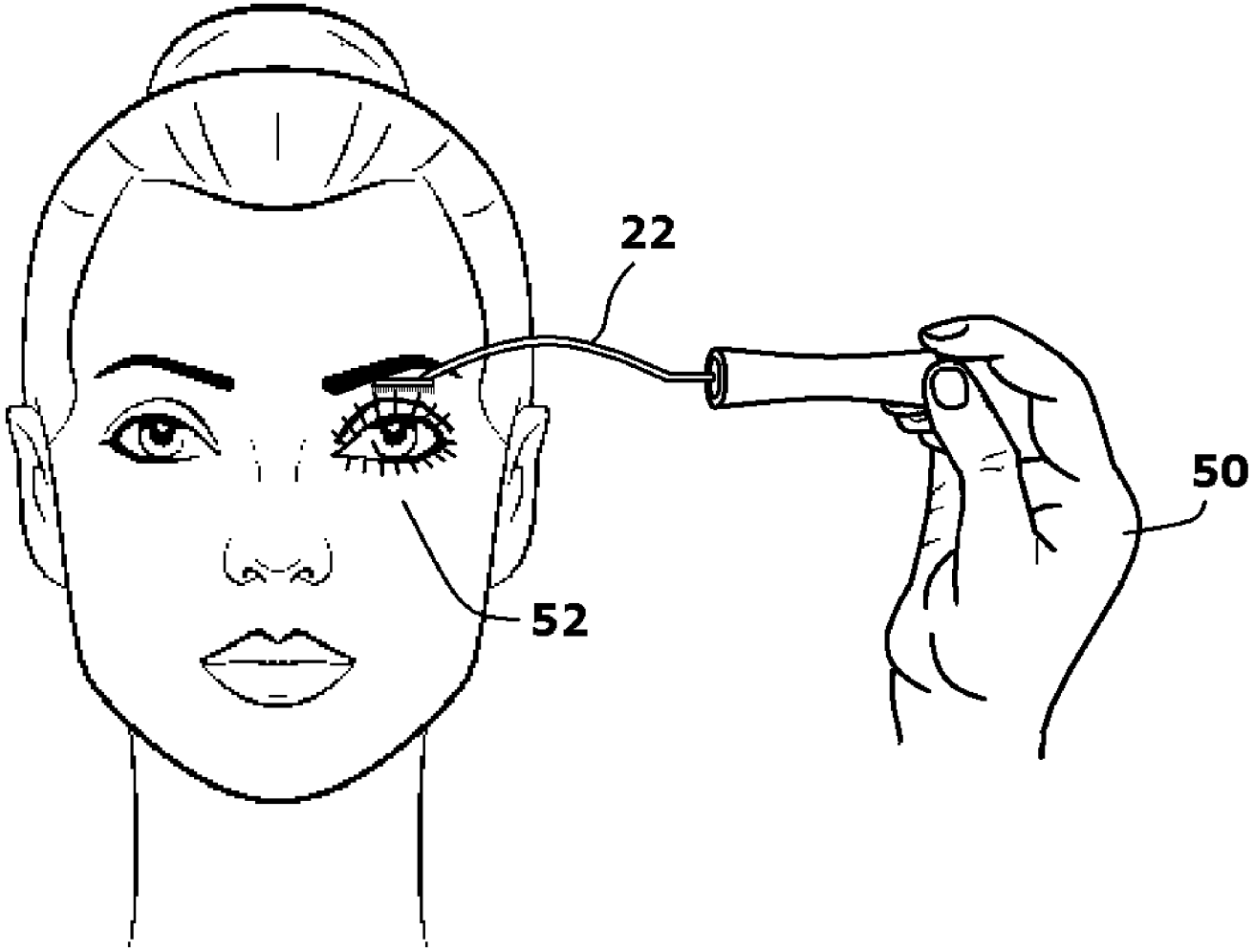
FIG. 4 shows the applicator of the exemplary embodiment in conjunction with a dominant hand and face, wherein mascara is being applied to a first eye.

Referring to FIG. 4 in conjunction with FIG. 1 and FIG. 2, it can be seen that the dominant hand 50 is then used to apply mascara 16 to a first eye 52 that is closest to the dominant hand 50. Since the rod 22 holds the brush head 20 along the midline 21 of the handle 18, the application of mascara 16 is the same as if a traditional straight rod applicator were being used.

Figure 5:
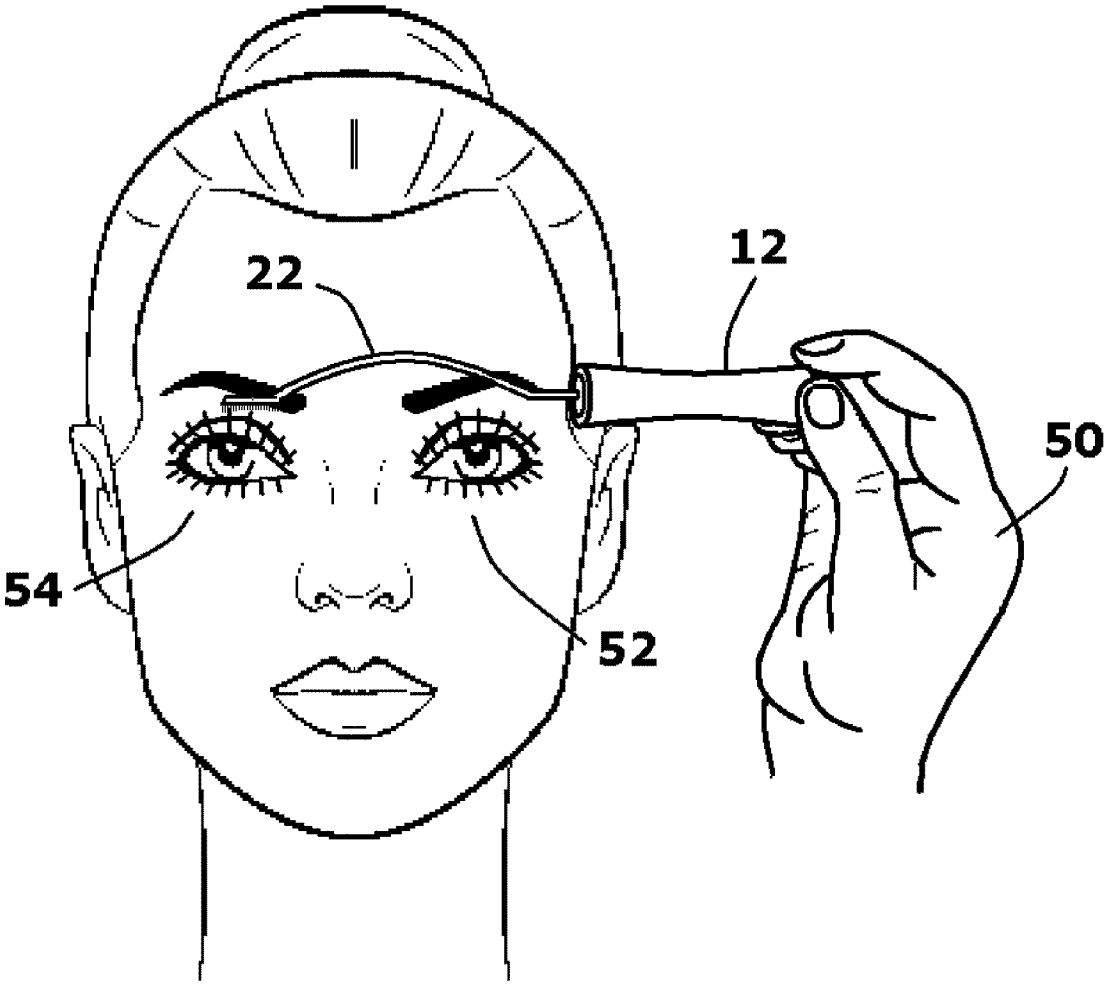
FIG. 5 shows the applicator of the exemplary embodiment in conjunction with a dominant hand and face, wherein mascara is being applied to a second eye.

Referring to FIG. 5 in conjunction with FIG. 1 and FIG. 2, it can be seen that the dominant hand 50 is then used to apply mascara 16 to a second eye 54 that is farthest from the dominant hand 50. The extended length of the rod 22 in the applicator 12 enables the brush head 20 to reach the second eye 54 without the handle 18 and dominant hand 50 blocking the forward view of the first eye 52. That is, the length of the rod 22 is at least as long as the distance between the left eye and the right side of the head, or the right eye and the left side of the head. If the rod 22 were straight, it would block the vision in the first eye 52 as mascara 16 is being applied to the second eye 54. However, the rod 22 is not straight. The rod 22 has an inclined section 36 and a curved section 40 that cause the rod 22 to pass around the first eye 52 as mascara 16 is being applied to the second eye 54. As such, a person can have a clear view of a mirror with his/her first eye 52 while mascara 16 is being applied to the second eye 54.

It will therefore be understood that the mascara application system 10 enables a person to effectively apply mascara 16 to both eyes while holding the applicator 12 in only the dominant hand 50. Since a person has more precise motor skills in his/her dominant hand 50, the mascara 16 can be applied with more accuracy. Furthermore, the quality of the application will be consistent across both eyes.

Figure 6:
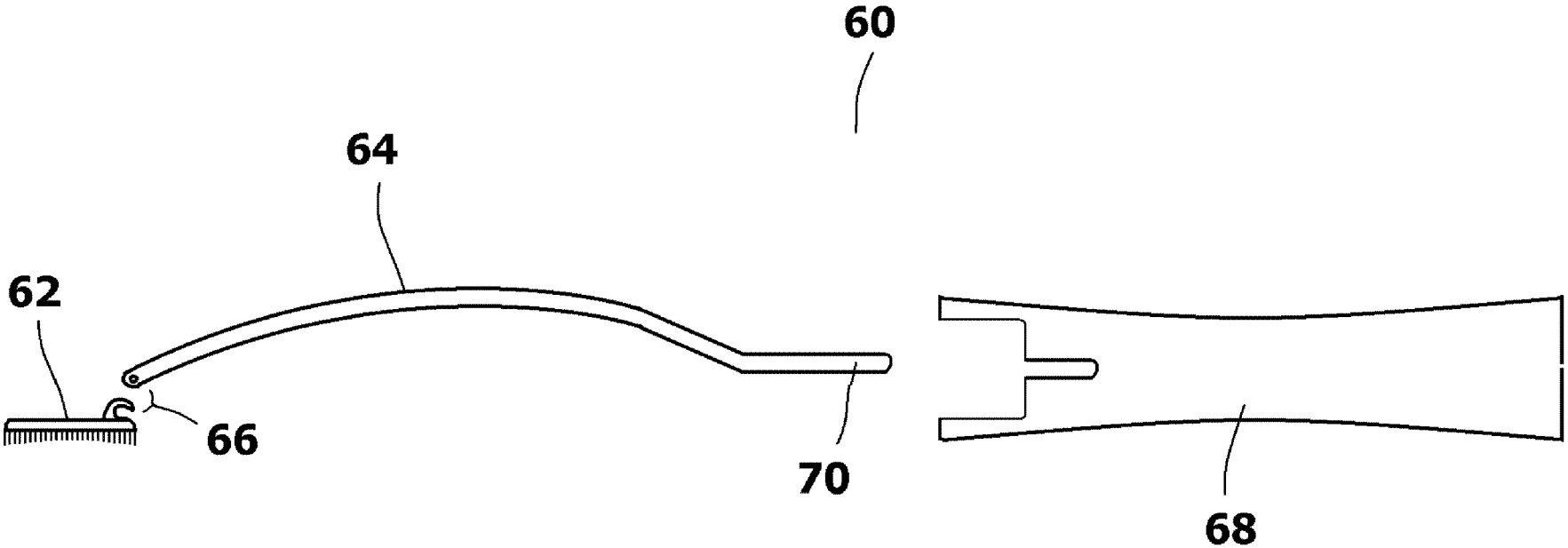
FIG. 6 shows an exploded view of an alternate embodiment of an applicator.

In the embodiment of the mascara application system 10 previously shown, the brush head 20 was permanently affixed to the elongated rod 22. Furthermore, the rod 22 was permanently affixed to the handle 18. These conditions can be altered. Referring to FIG. 6, an embodiment of the mascara application system 60 is shown that is modular in its construction. In this embodiment, a brush head 62 can connect to an elongated rod 64 using a connector 66. The connector 66 enables the brush head 62 to be selectively attached to, and detached from, the rod 64. In this manner, different brush heads can be selectively attached to the rod 64. This enables a person to select a brush head design that suits the needs of the user. The connector 66 also enables a fresh brush head to be connected to the rod 64, should the original brush head 62 become clogged or damaged.

Likewise, the rod 64 can be made to optionally connect to a handle 68. The ability of the rod 64 to disconnect from the handle 68 enables different rod shapes and lengths to be used. Provided the selected rod can fit into the container, a person can select a rod that works best with the shape and size of their face and with their own preferences.

In the embodiments previously described, a curved section on the rod is used to avoid blocking a near eye when mascara is applied to the far eye. It should be understood that the use of the curved section is exemplary and other configurations can be used to the same effect.

Figure 7:
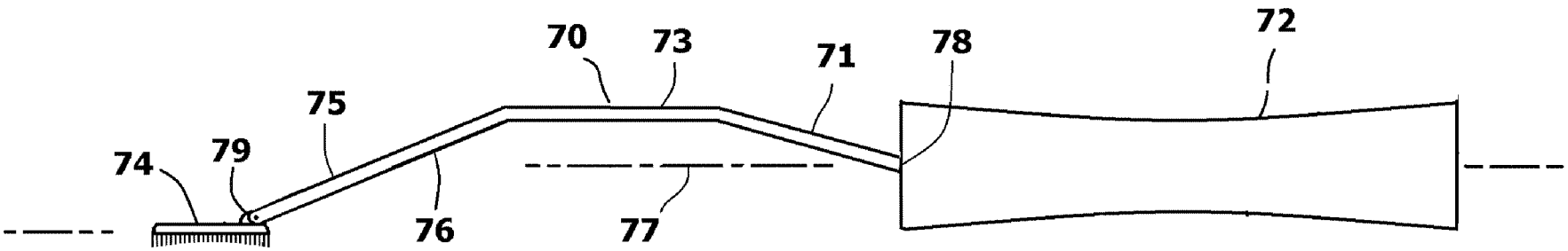
FIG. 7 shows an alternate embodiment of an applicator.
Figure 8:
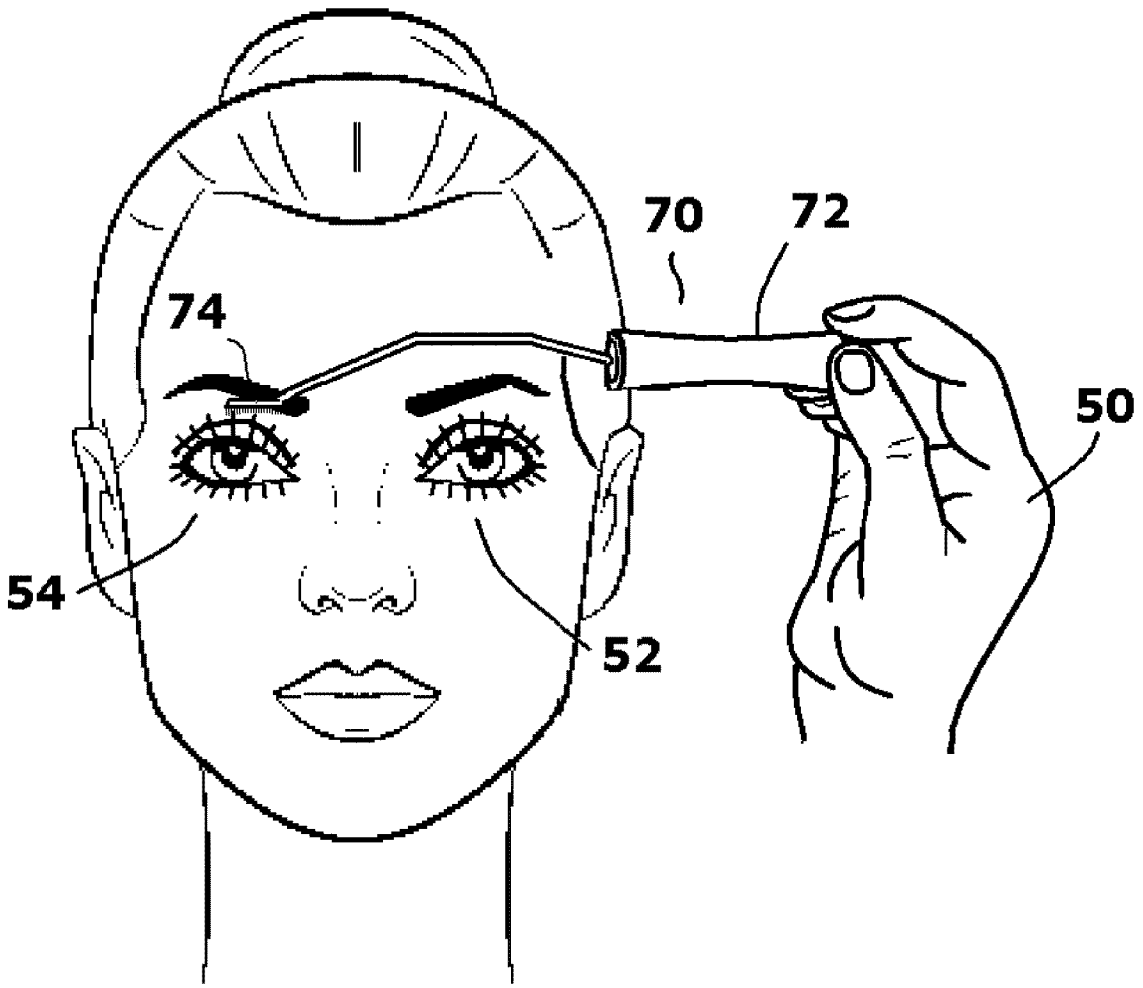
FIG. 8 shows the applicator of the embodiment of FIG. 7 in conjunction with a dominant hand and face, wherein mascara is being applied to an eye.

Referring to FIG. 7 in conjunction with FIG. 8, it can be seen that the applicator 70 has a handle 72, a brush head 74 and a rod 76 that connects the brush head 74 to the handle 72. The handle 72 is symmetrically formed about a midline 77. The rod 76 extends into the handle 72. The rod 76 is flexible and extends between a first end 78 and a second end 79. The first end 78 of the rod 76 is anchored within the handle 72. This causes the rod 76 to extend from the handle 72 as a cantilever. The second end 79 of the rod 76 supports the brush head 74. The rod 76 is elongated and follows a complex shape between its first end 78 and its second end 79. The preferred length of the rod 75 is between seven centimeters and thirteen centimeters.

The rod 76 has an inclined section 71 that extends from the first end 78 of the rod 76. The inclined section 71 inclines away from the midline 77 at an angle of between 20 degrees and 45 degrees. The inclined section 71 extends to a lateral section 73 and then to a declined section 75. The declined section 75 leads to the brush head 74. The rod 76 holds the brush head 74 parallel to the midline 77 of the handle 72 but offset by a distance of between two centimeters and five centimeters. The dominant hand 50 can then be used to apply mascara 16 to a second eye 54 that is farthest from the dominant hand 50. The extended length of the rod 76 enables the brush head 74 to reach the second eye 54 without blocking the forward view of the first eye 52.

Figure 9:
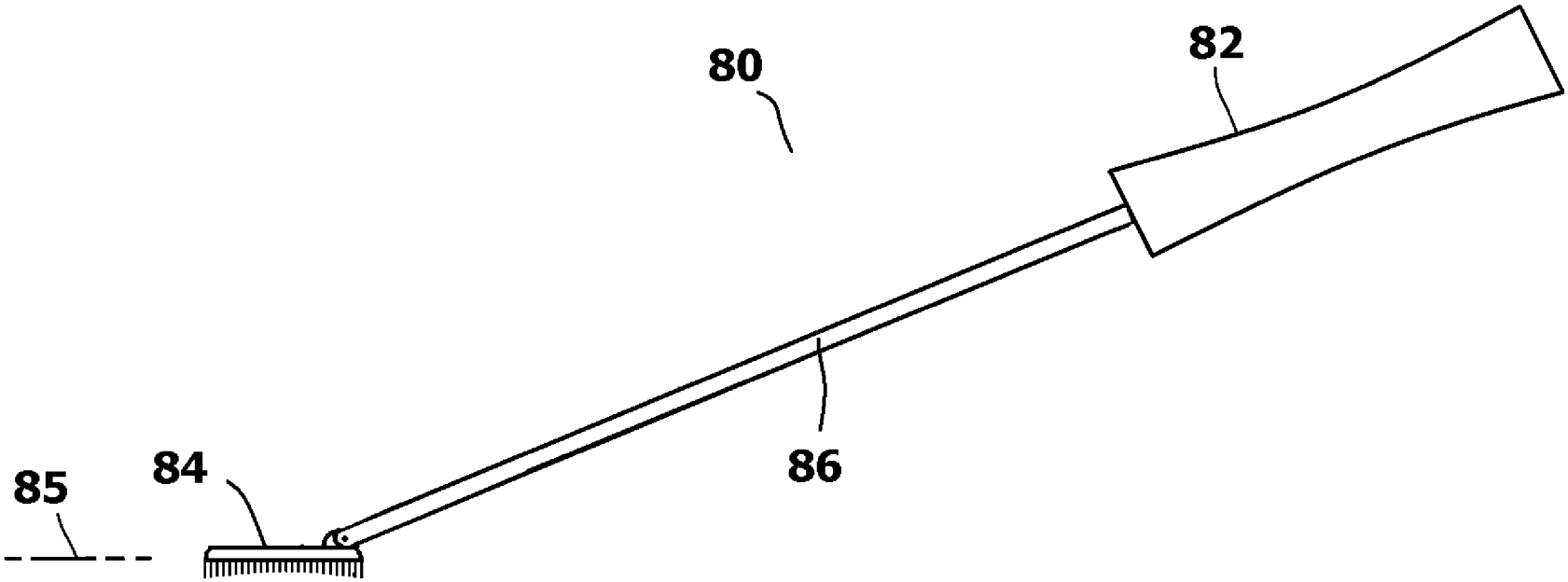
FIG. 9 shows an alternate embodiment of an applicator.

Referring to FIG. 9 an alternate embodiment of an applicator 80 is shown. The applicator 80 has a handle 82, a brush head 84 and a straight rod 86 that connects the brush head 84 to the handle 82. The handle 82 is symmetrically formed about a midline. The straight rod 86 extends into the handle 82. The straight rod 86 is anchored within the handle 82. This causes the straight rod 86 to extend from the handle 82 as a cantilever. The straight rod 86 supports the brush head 84. The straight rod 86 is elongated and has a preferred length between seven centimeters and thirteen centimeters.

The brush head 84 extends along an imaginary axis 85. The brush head 84 is free to pivot relative the straight rod 86, therein creating a relative angle between the axis 85 of the brush head 84 and the straight rod 86 that is between 160 degrees and 110 degrees. At this angle, the brush head 84 can be vertically offset from the start of the handle 82 by offset by a distance of between two centimeters and five centimeters. The length of the straight rod 86 and the relative angle of the brush head 84 to the handle 82 enable the dominant hand to apply mascara to the eye that is farthest from the dominant hand without blocking the forward view of the intervening eye.

It will be understood that the embodiments of the present invention that are illustrated and described are merely exemplary and that a person skilled in the art can make many variations to those embodiments. For instance, the length, width and curvature of both the applicator and the container can be changed to accommodate different volumes of mascara. Likewise, straight sections of the rod can be combined with curved sections and inclined sections to produce rod configurations that are not illustrated, but serve the same function as the illustrated configurations. All such embodiments are intended to be included within the scope of the present invention as defined by the appended claims.

What is claimed is:

1. A system for the application of mascara, comprising:

a container that holds a volume of mascara;

an applicator having a brush head, a handle and an elongated rod that interconnects said brush head to said handle, wherein said handle progresses along a midline between a first end and an opposite second end, wherein said brush head extends along a mid-axis, and said elongated rod has a curved section that follows a curved path as said elongated rod progresses toward said brush head from said handle so that said mid-axis of said brush head is vertically offset from said midline of said handle by at least two centimeters.

2. The system according to claim 1, wherein said elongated rod has a length of between seven centimeters and thirteen centimeters.

3. The system according to claim 1, wherein said elongated rod also contains a straight section that is aligned with said midline of said handle, wherein said straight section is connected to said handle.

4. The system according to claim 3, wherein said elongated rod further includes an inclined section that inclines away from said midline, wherein said inclined section is interposed between said straight section and said curved section.

5. The system according to claim 4, wherein said inclined section inclines at an angle of between 20 degrees and 45 degrees with respect to said midline.

6. The system according to claim 1, wherein said brush head is attached to said elongated rod at a flexible connection that enables said brush head to move relative said elongated rod.

7. The system according to claim 1, wherein a connector joins said brush head to said elongated rod, wherein said connector enables said brush head to be selectively connected and disconnected from said elongated rod.

8. The system according to claim 1, wherein said container has a threaded neck and said handle has a cap depression sized to engage and seal said threaded neck.

9. The system according to claim 1, wherein said container is sized to accommodate said brush head and said elongated rod within said container when said container and said applicator are interconnected.

10. A mascara applicator, comprising:

a brush head that extends along a mid-axis;

a handle wherein said handle has a first end and an opposite second end, and wherein said handle progresses along an imaginary midline between said first end and said second end;

an elongated rod that interconnects said brush head to said handle, said elongated rod supporting said mid-axis of said brush head offset from said midline of said handle by at least two centimeters, wherein said elongated rod has a straight section that progresses in line with said midline and at least one curved section that is not in line with said midline.

11. The applicator according to claim 10, wherein said elongated rod has a length of between seven centimeters and thirteen centimeters.

12. The applicator according to claim 10, wherein said elongated rod further includes an inclined section that inclines away from said midline, wherein said inclined section is interposed between said straight section and said at least one curved section.

13. The applicator according to claim 12, wherein said inclined section inclines at an angle of between 20 degrees and 45 degrees with respect to said midline.

14. The applicator according to claim 11, wherein said brush head is attached to said elongated rod at a flexible connection that enables said brush head to move relative said elongated rod.

15. The applicator according to claim 11, wherein a connector joins said brush head to said elongated rod, wherein said connector enables said brush head to be selectively connected and disconnected from said elongated rod.

16. A mascara applicator, comprising:

a handle wherein said handle has a first end and an opposite second end and a midline between said first end and said second end;

a brush head that extends along a mid-axis;

an elongated rod that extends from said first end of said handle, wherein said elongated rod interconnects said brush head to said handle, said elongated rod supporting said brush head so that said mid-axis of said brush head is vertically offset from said midline by at least two centimeters, wherein said elongated rod has a straight section that forms an angle of between 120 degrees and 160 degrees with said midline of said brush head.

17. The applicator according to claim 16, wherein said elongated rod has a length of between seven centimeters and thirteen centimeters.

* * * * *